US006958455B1

(12) United States Patent
Lui

(10) Patent No.: US 6,958,455 B1
(45) Date of Patent: Oct. 25, 2005

(54) LOCK-ON/LOCK-OFF TOOL SWITCH

(75) Inventor: Nelson Man Hoi Lui, Tai Po (HK)

(73) Assignee: Defond Components Limited, Chai Wan (HK)

( * ) Notice: Subject to any disclaimer, the term of this patent is extended or adjusted under 35 U.S.C. 154(b) by 0 days.

(21) Appl. No.: 10/941,894

(22) Filed: Sep. 16, 2004

(51) Int. Cl.[7] ..... H01H 13/02
(52) U.S. Cl. ..... 200/43.17; 200/522; 200/321; 200/332.2
(58) Field of Search ..... 200/43.17, 61.85, 200/522, 318, 318.1, 322, 332.1, 334, 332.2

(56) References Cited

U.S. PATENT DOCUMENTS 3,953,696 A * 4/1976 Reimann et al. ..... 200/522
4,097,705 A * 6/1978 Harvell ..... 307/126
4,180,716 A * 12/1979 Suzuki ..... 200/320
4,271,342 A * 6/1981 Sistare ..... 200/332.2
4,934,494 A * 6/1990 Fushiya et al. ..... 477/8
5,012,057 A * 4/1991 Inuyama ..... 200/522
6,555,773 B1 * 4/2003 Broghammer et al. ... 200/61.85
6,812,425 B1 * 11/2004 Wong ..... 200/522

* cited by examiner

*Primary Examiner*—Michael A. Friedhofer
(74) *Attorney, Agent, or Firm*—Leydig, Voit & Mayer, Ltd.

(57) ABSTRACT

A trigger mechanism for a power tool includes a chassis; a trigger mounted to the chassis for movement between ON and OFF positions; an electrical switch mounted to the chassis for activation by movement of the trigger between the ON and OFF positions to close and open an electrical circuit; and a locking mechanism comprising a lock button and a latch, user-depression of the lock button causing deflection of the latch to enable depression of the trigger in the OFF position, the pushbutton retaining the latch deflected in the OFF position of the trigger until further depression of the trigger beyond the ON position releases the pushbutton from the latch to enable release of the trigger for return to the OFF position.

7 Claims, 4 Drawing Sheets

LOCK-ON/LOCK-OFF TOOL SWITCH

The present invention relates to an electric trigger switch of the type intended for use in hand-held power tools such as electric drills or rotary drive tools for example.

BACKGROUND OF THE INVENTION

The invention relates non-exclusively to an electric trigger switch with a locking mechanism enabling the trigger to be locked in ON and OFF positions.

It is known to provide locking mechanisms for power tool trigger switches. These mechanisms typically include a pushbutton enabling the trigger to be locked down in the ON position, so that there is no need for a user to keep pulling the trigger. Inadvertent depression of the trigger from the OFF position to the ON position presents a safety hazard.

It is an object of the present invention to overcome or substantially ameliorate the above problem and/or more generally to provide an improved locking trigger switch for a power tool.

SUMMARY OF THE INVENTION

There is disclosed herein a trigger mechanism for a power tool, comprising:

a chassis;

a trigger mounted to the chassis for movement between ON and OFF positions;

an electrical switch mounted to the chassis for activation by movement of the trigger between the ON and OFF positions to close and open an electrical circuit; and a locking mechanism comprising a lock button and a latch, the lock button being arranged upon user-activation to cause displacement of the latch to allow depression of the trigger from the OFF position to the ON position and then to engage the latch to retain the trigger in the ON position until further depression of the trigger beyond the ON position releases the lock button from the latch to enable release of the trigger for return to the OFF position.

Preferably, the trigger is mounted to slide linearly upon the chassis.

Preferably, the latch comprises a resilient plate secured to the trigger.

Preferably, the locking mechanism further comprises an abutment affixed to or formed integrally with the chassis and against which the latch abuts upon depression of the trigger, unless the lock button is depressed.

Preferably, the lock button comprises a pin comprising a shaft and an enlarged head, and the latch comprises an aperture through which the enlarged head of the pin extends.

Preferably, the aperture of the resilient plate is elongate, having one end through which the pin head can pass and another end through which the pin head cannot pass.

Preferably, the electrical switch includes two pairs of terminals, each pair being for an individual electrical circuit that is openable and closable upon movement of the trigger.

BRIEF DESCRIPTION OF DRAWINGS

A preferred form of the invention will now be described, by way of example only, with reference to the accompanying drawings, in which.

DETAILED DESCRIPTION OF PREFERRED EMBODIMENT

Figure 1:
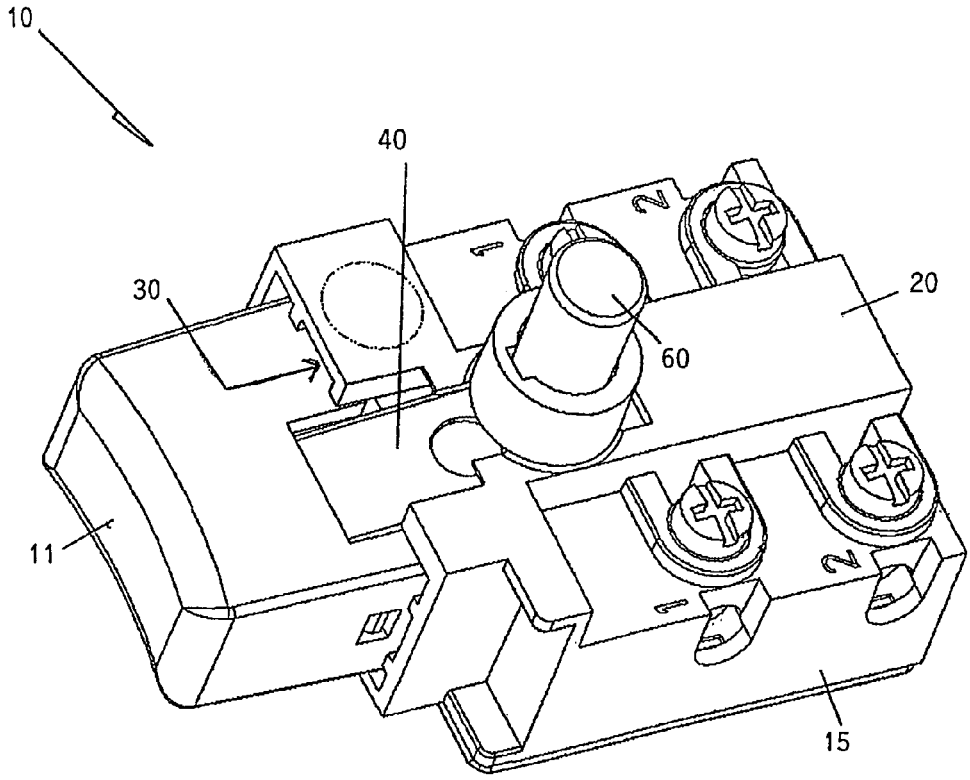
FIG. 1 is a perspective view of an embodiment of a trigger mechanism in accordance with the invention, with its trigger released to an OFF position.
Figure 2:
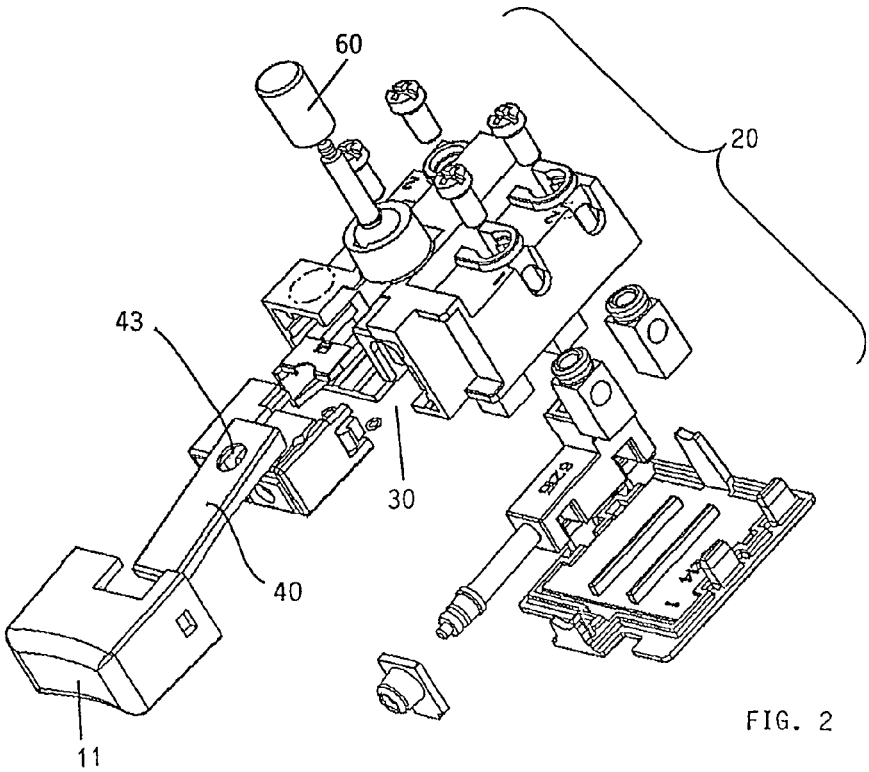
FIG. 2 is an exploded perspective view of the trigger mechanism of FIG. 1, showing the trigger and a lock button and latch for locking the trigger.
Figure 3:
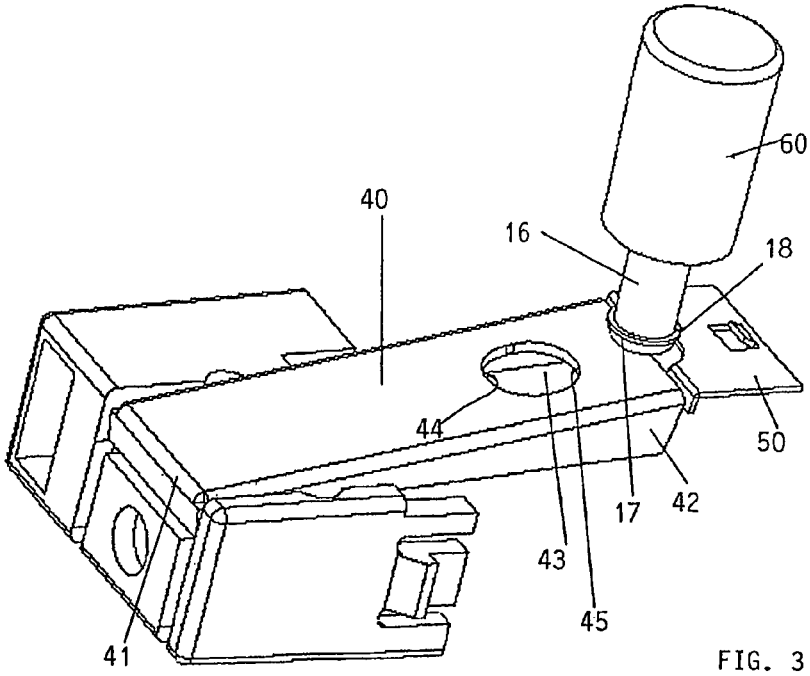
FIG. 3 is a perspective view of the trigger, lock button and latch of FIG. 2.

Referring to the drawings, there is shown a trigger mechanism 10 embodying the invention for a hand-held power tool such as an electric drill, grinder, sander, saw, rotary driving tool or any other power tool or electrical device of the type that includes a finger-activated pull trigger for switching on and off the tool or device.

The trigger mechanism 10 has a moulded plastics chassis 15 to be mounted internally of a power tool body nearby its handle. A switchbox 20 is formed integrally upon the chassis. The mechanism 10 includes a spring-loaded plastics trigger 11 mounted to slide linearly within a recess 30 in the chassis 15.

A locking mechanism is provided to prevent accidental depression or pulling of the trigger 11 and also to lock the trigger 11 in the ON position during use until the trigger 11 is depressed beyond the ON position by the application of finger force to the trigger 11.

There is a spring (not shown) inside the trigger 11 and bearing against the chassis 15 to bias the trigger 11 forward towards the OFF position.

Attached to and extending backwards from the trigger 11 is a metallic or plastics latch 40. The latch 40 is in the form of a resilient plate having its forward end 41 secured to the trigger 11 and its rear end 42 free-floating. The resilient plate 40 is rigid and is connected to the trigger 11 by a springy part (web) so that it is resiliently pivotable or is in itself resilient by nature like a leaf spring. Positioned adjacent to the rear end 42 of the latch 40 is an abutment member 50 affixed upon the chassis 15.

The latch 40 has an aperture 43 which is slightly elongated having one end (its forward end) 44 slightly wider than its other end (its rearward end) 45.

Also mounted to the chassis 15 is a lock button 60 that is spring-biased (spring not shown) to an UP (or release) position. The lock button 60 is adapted to move linearly in a direction transverse to that at which the trigger 11 moves. A pin 16 depends from the button 60 and has a broad head 17 at its bottom tip. The head 17 can fit through the forward end 44 of the aperture 43, but is too wide to fit through the rearward end 45 of the aperture 43. The head 17 has a flange 18 that bears under the periphery of the rearward end 45 of the aperture 43 to engage with the latch 40, whereby the lock button 60 is held down and in particular the latch 40 is locked inwards to retain the trigger 11 in the ON position during use.

As depicted in some of the figures, the switchbox 20 includes two pairs of electrical terminals 1 and 2. Each pair of these terminals defines an electrical switch that is operable by movement of the trigger 11 between the ON and OFF positions for closing and opening individual electrical circuits. One such circuit includes an electric motor for driving the power tool, whilst the other circuit may be employed for an auxiliary electrical element such as a power-on indicator lamp.

Figure 4:
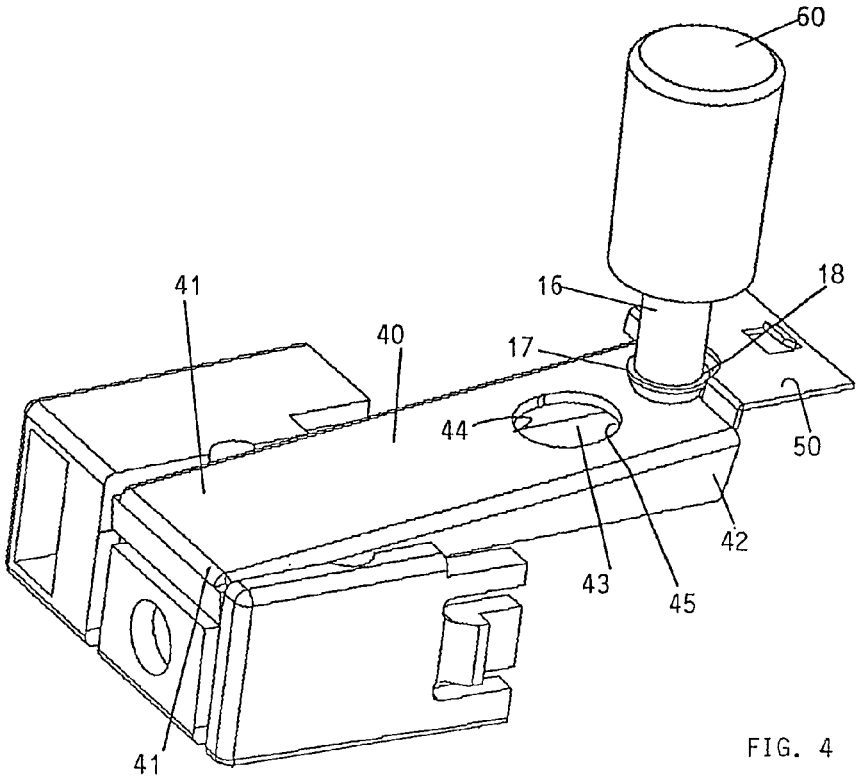
FIG. 4 is a perspective view subsequent to FIG. 3, showing the lock button slightly depressed.
Figure 5:
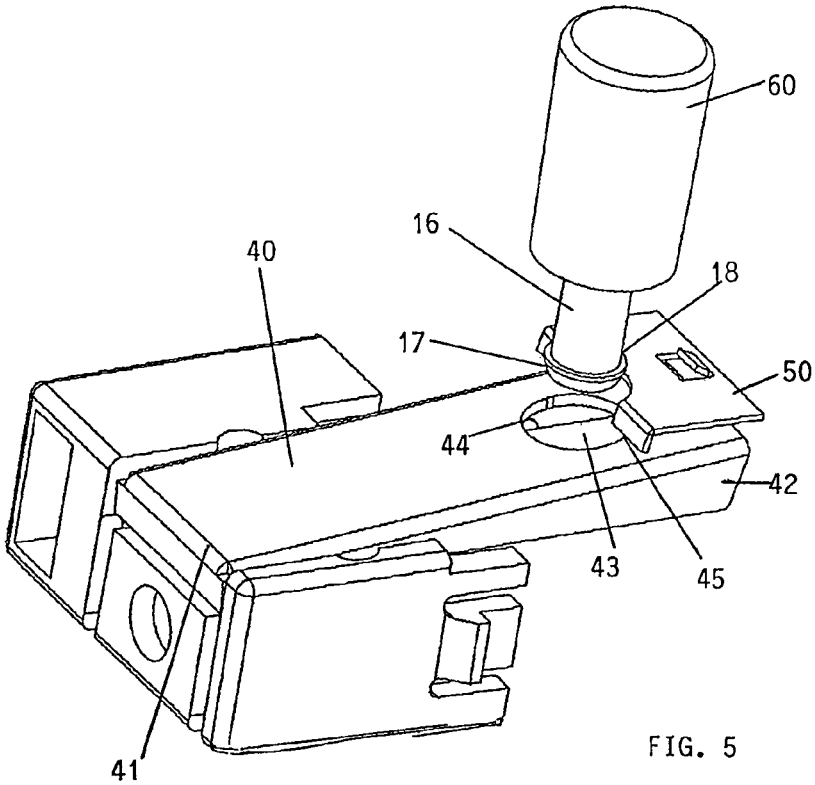
FIG. 5 is a perspective view subsequent to FIG. 4, showing the latch going past an abutment.

In use, the trigger 11 cannot be depressed until the lock button 60 is pressed in beyond the position depicted in FIG. 4 at which point the head 17 bears down upon the upper surface of the rear end 42 of the latch 40 so that the rear end 42 is deflected to clear the abutment 50. If an attempt is made to depress the trigger 11 before the lock button 60 is depressed, the rear end 42 of the latch 40 clashes with the abutment 50.

With maintained downward finger force on the lock button 60, the trigger 11 can be depressed until such time as the pin head 17 passes through the forward end 44 of the aperture 43. Release of finger force from the trigger 11 allows the trigger 11 and latch 40 to move slightly forward until the pin 16 bears against the back edge of the rearward end 45 of the aperture 43 whereupon release of finger force from lock button 60 allows the flange 18 to bear and engage upwardly upon the bottom surface of the latch 40 as mentioned earlier.

Figure 6:
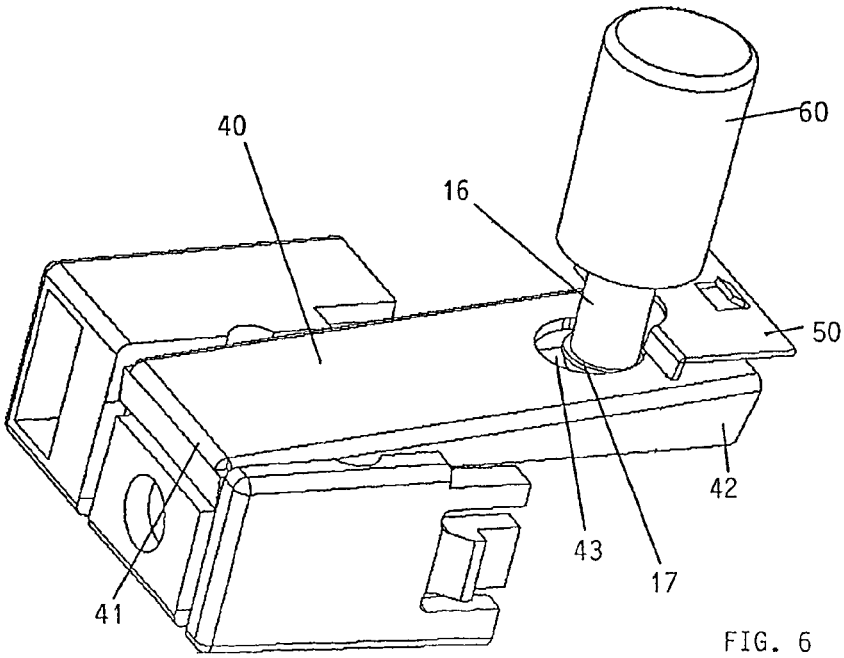
FIG. 6 is a perspective view subsequent to FIG. 5, showing the lock button fully depressed and retained.
Figure 7:
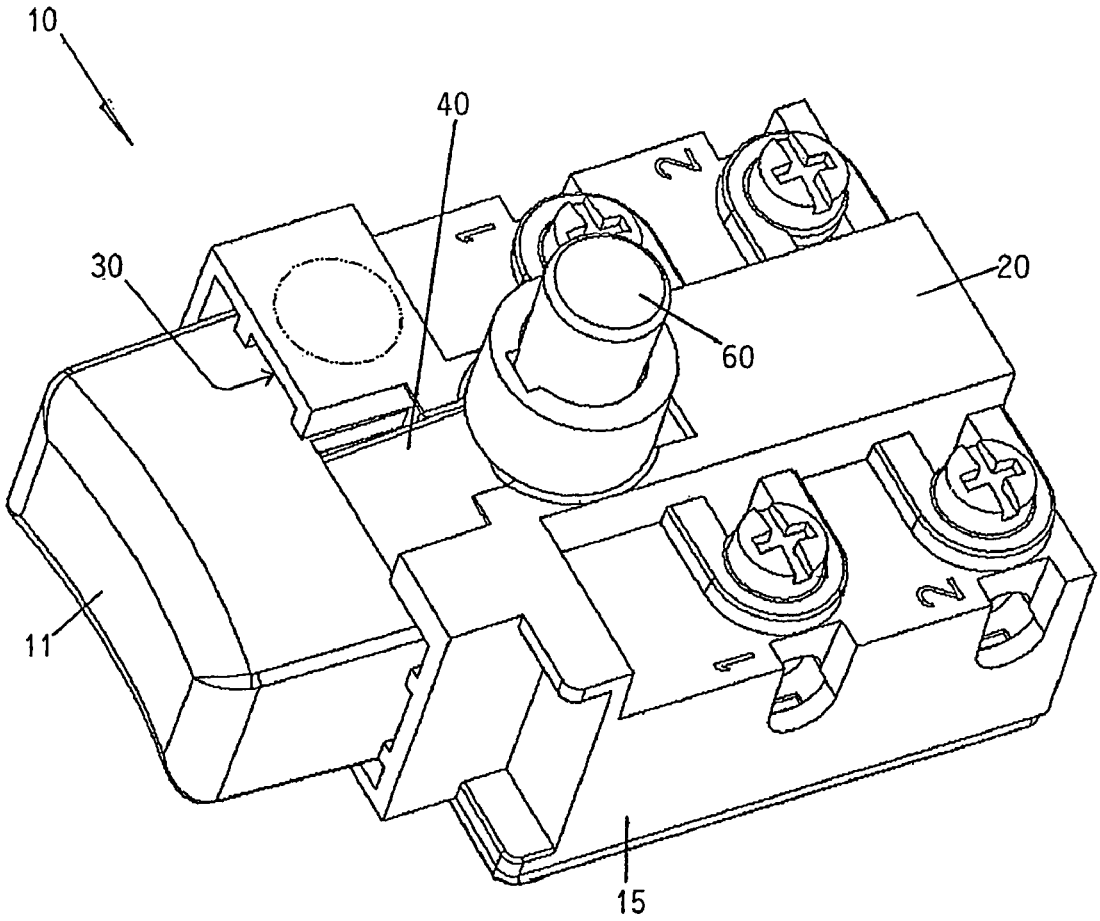
FIG. 7 is a perspective view of the trigger mechanism of FIG. 1, with its trigger depressed to an ON position.

In the ON position of the trigger 11 in FIG. 6, the electrical switches within the switchbox 20 have closed circuits across the electrical terminal pairs 1 and 2. In order to release the trigger 11, it only needs to be simply depressed with the latch 40 beyond the ON position so that the flange 18 releases from the bottom surface of the latch 40 to enable the pin head 17 to lift through the forward end 44 of the aperture 43. At this point, finger force can be released from the trigger 11 so that the trigger 11 will self-return to the OFF position.

Thus, the lock button 60 is arranged upon user-activation to cause displacement of the latch 40 to allow depression of the trigger 11 from the OFF position to the ON position, and then to engage the latch 40 to retain the trigger 11 in the ON position, and finally to disengage from the latch 40 upon further depression of the trigger 11 beyond the ON position to allow release of the trigger 11 for return to the OFF position.

The invention has been given by way of example only, and various modifications and/or variations to the described embodiment may be made by persons skilled in the art without departing from the scope of the invention as specified in the accompanying claims. For example, the trigger 11 may pivot upon a pin rather than slide linearly, or the aperture 43 in the latch 40 may be perfectly circular instead of having opposite ends of different sizes.

What is claimed is:

1. A trigger mechanism for a power tool, comprising:

a chassis;

a trigger mounted to the chassis for movement between ON and OFF positions;

an electrical switch mounted to the chassis for activation by movement of the trigger between the ON and OFF positions to close and open an electrical circuit; and a locking mechanism comprising a lock button and a latch, the lock button being arranged upon user-activation to cause displacement of the latch to allow depression of the trigger from the OFF position to the ON position and then to engage the latch to retain the trigger in the ON position until further depression of the trigger beyond the ON position releases the lock button from the latch to enable release of the trigger for return to the OFF position.

2. The trigger mechanism as claimed in claim 1, wherein the trigger is mounted to slide linearly upon the chassis.

3. The trigger mechanism as claimed in claim 2, wherein the latch comprises a resilient plate secured to the trigger.

4. The trigger mechanism as claimed in claim 3, wherein the locking mechanism further comprises an abutment affixed to or formed integrally with the chassis and against which the latch abuts upon depression of the trigger, unless the lock button is depressed.

5. The trigger mechanism as claimed in claim 4, wherein the lock button comprises a pin comprising a shaft and an enlarged head, and the latch comprises an aperture through which the enlarged head of the pin extends.

6. The trigger mechanism as claimed in claim 5, wherein the aperture of the resilient plate is elongate, having one end through which the pin head can pass and another end through which the pin head cannot pass.

7. The trigger mechanism as claimed in claim 1, wherein the electrical switch includes two pairs of terminals, each pair being for an individual electrical circuit that is openable and closable upon movement of the trigger.

* * * * *